US009185940B2

(12) United States Patent
Sparks

(10) Patent No.: US 9,185,940 B2
(45) Date of Patent: Nov. 17, 2015

(54) SECTIONALIZED OVER-GARMENT

(71) Applicant: Daniel C. Sparks, Pikesville, MD (US)

(72) Inventor: Daniel C. Sparks, Pikesville, MD (US)

( * ) Notice: Subject to any disclaimer, the term of this patent is extended or adjusted under 35 U.S.C. 154(b) by 145 days.

(21) Appl. No.: 14/088,891

(22) Filed: Nov. 25, 2013

(65) Prior Publication Data

US 2015/0143602 A1 May 28, 2015

(51) Int. Cl.
*A41D 15/04* (2006.01)
*A41D 3/00* (2006.01)
*A41D 13/002* (2006.01)

(52) U.S. Cl.
CPC *A41D 15/04* (2013.01); *A41D 3/00* (2013.01); *A41D 13/002* (2013.01); *A41D 2200/20* (2013.01)

(58) Field of Classification Search
CPC ..... A41D 13/0015; A41D 1/22; A41B 13/06
USPC ..... 2/89, 69, 69.5, 93, 94, 95, 85, 70, 80, 2/72, 86, 96, 102
See application file for complete search history.

(56) References Cited

U.S. PATENT DOCUMENTS 536,383 A 3/1895 Huyck
1,610,799 A 12/1926 Lack et al.
1,641,039 A 8/1927 Beaud
1,940,224 A 12/1933 Munro
2,072,644 A 3/1937 McBee
2,560,243 A * 7/1951 Peterson ..... 602/4
2,738,512 A * 3/1956 Winer ..... 2/80
3,837,006 A 9/1974 Laseman
D249,196 S 9/1978 Wrightson
5,101,513 A 4/1992 Bowers
5,226,193 A * 7/1993 Chen ..... 2/69.5
5,560,043 A * 10/1996 Armstrong ..... 2/69.5
5,815,833 A * 10/1998 Kuo ..... 2/69.5
6,061,831 A * 5/2000 Rudolph et al. ..... 2/69.5
6,918,885 B2 * 7/2005 Moore et al. ..... 602/4
8,448,263 B2 5/2013 Auer et al.
2008/0066229 A1 3/2008 Auer et al.

* cited by examiner

*Primary Examiner* — Tejash Patel
(74) *Attorney, Agent, or Firm* — Nydegger & Associates

(57) ABSTRACT

A sectionalized over-garment which is convertible for appropriate climatic adaptation during extended outdoor use includes a vest section and a skirt section. The vest section includes a front body opening, as well as arm holes and a pair of access holes respectively located between an arm hole and the front opening. Importantly, the user can manipulate the open/close function for each hole/opening from inside the vest section. As a parka, the vest section includes a hood. The skirt section can be engaged with the vest section to establish a full body over-garment. And, alone, the skirt section can function as a small tent or shelter. When a panel is deployed from the bottom of the skirt section to cover the feet, and with the opening and holes of the vest section closed, the over-garment functions as a sleeping bag.

18 Claims, 2 Drawing Sheets

SECTIONALIZED OVER-GARMENT

FIELD OF THE INVENTION

The present invention pertains to an over-garment for use by persons during strenuous activities out-of-doors, when extra protection from adverse climatic conditions is desirable or necessary. More particularly, the present invention pertains to over-garments which provide a user with an effective freedom-of-movement that is unrestricted, unhindered and unencumbered by the over-garment. The present invention is particularly, but not exclusively, useful as an over-garment for protecting an active user during outdoor activities which can be easily converted between a plurality of different functional configurations, to include: i) a protective parka, ii) a full body over-garment, iii) a blanket/quilt or shelter, and iv) a sleeping bag.

BACKGROUND OF THE INVENTION

In any twenty-four hour period, anywhere in the world, weather conditions will inevitably change. As is well known, such changes can sometimes be considerable and, if not properly prepared for, can be debilitating or, at best, uncomfortable. The situation becomes even more critical when a person is exposed to adverse weather over prolonged periods of time that exceed twenty-four hours. An additional consideration for long-term exposure is the need for sleep.

Many outdoor recreational activities such as hunting, fishing and hiking, as well as vocational activities such as law enforcement, search/rescue, fire-fighting and military operations all require specifically different clothing and equipment. Nevertheless, they all have a common interest in maintaining user comfort and a high-performance capability. In particular, despite whatever the weather conditions might be, there is a need, and a desire, to keep the individual warm and dry.

In light of the above, it is an object of the present invention to provide an over-garment that will afford its user with a freedom-of-movement for outdoor activities that is unrestricted, unhindered and unencumbered by the over-garment. Another object of the present invention is to provide an over-garment which can be easily converted between a plurality of different functional configurations, to include: i) a protective parka, ii) a full body over-garment, iii) a blanket/quilt or shelter and, iv) a sleeping bag. Still another object of the present invention is to provide an outdoor over-garment that is easy to use, simple to manufacture and relatively cost effective.

SUMMARY OF THE INVENTION

In accordance with the present invention, a sectionalized over-garment is provided for use in protecting a human user from adverse climatic conditions. In overview, the over-garment of the present invention includes a vest section and a skirt section. For reference purposes in describing the over-garment, consider that the user defines a vertical axis extending between his/her head and feet when he/she is standing. Further, for disclosure purposes, modifiers such as upper (above), lower (below), left (lateral), right (lateral), front (anterior) and back (posterior) are anatomically referenced on the user.

Structurally, the over-garment of the present invention includes a vest section that is dimensioned to drape downwardly from the shoulders and over the torso of the user. The vest section is formed with a collar that is centered on the axis at the shoulders of the user, and it includes a hood that is connected with the collar to create a parka. Further, a neck drawstring is oriented along the collar to close the hood onto the neck of the user, and a face drawstring is oriented on the hood to hold the hood on the head of the user with the face of the user exposed.

For the present invention, the vest section is formed with a front (anterior) body opening that is substantially coplanar with the axis, and which extends from the collar to a bottom hem of the vest section. A zipper is provided for selectively opening and closing the front body opening. Also, for reasons more fully appreciated below, the vest section includes a zipper-half that extends along the length of the bottom hem for interaction with the skirt section of the over-garment.

Additionally, the vest section is formed with a pair of lateral (side) arm holes that are oriented substantially parallel to the axis and parallel to the body opening. In detail, these arm holes respectively extend from a shoulder portion of the vest section to a point that is located adjacent to the bottom hem of the vest section. And, each arm hole includes an arm hole zipper that is affixed with the vest section for selectively opening and closing the arm hole. Further, the vest section is formed with a pair of access holes that are located between the frontal body opening and a respective arm hole. Each access hole is oriented substantially parallel to the body opening. Also, similar to the arm holes, each access hole is provided with an access zipper for selectively opening and closing the access hole. Used alone, the vest section can be used as a parka. Further, the vest section is intentionally oversized to allow the user to keep his/her arms inside the vest section, and against the torso, to improve the efficiency of body heat.

As noted above, in addition to the vest section, the over-garment of the present invention also includes a skirt section. In detail, the skirt section is substantially rectangular shaped, with an upper edge and a lower edge, and with opposed, parallel side-edges extending between the upper and lower edges. A zipper-half extends along the upper edge of the skirt section for engagement with the zipper-half of the vest section (noted above) to connect the skirt section with the vest section. Also, a side-edge zipper-half is affixed to each side-edge of the skirt section for their selective engagement with each other to wrap and hold the skirt section around the legs of the user. A belt is incorporated into the skirt section along its upper edge, to cinch the skirt section to the waist of the user.

For reference purposes, the skirt section defines a centerline that is located midway between, and generally parallel to, the upper edge and the lower edge of the skirt section. An upper panel extends over the skirt section from its upper edge to the centerline. For this relationship, the upper panel is connected to the skirt section along its upper edge as well as along the side-edges between the upper edge and the centerline. The upper panel also includes an upper zipper-half that is affixed to the upper panel to be positioned adjacent and along the centerline. Similarly, a lower panel extends from the lower edge of the skirt section to the centerline. Also, there is a lower zipper-half that is affixed to the lower panel for selective engagement with the upper zipper-half to hold the lower panel over the skirt section between the lower edge of the skirt section and the centerline. Further, a fastener is located along each of the opposed side-edges of the skirt section. More specifically, these fasteners are located between the lower edge of the skirt section and its centerline to secure the lower panel against the skirt section when the upper and lower zipper-halves are engaged with each other. Further, a drawstring is incorporated into the lower panel adjacent the lower zipper-half. The purpose for this drawstring is to cinch the lower panel over the feet of the user.

Specifically, this is to be done when the lower panel has been disengaged from the upper zipper-half on the upper panel, and the lower panel has been released from the fasteners. Thus, with the skirt section closed around the legs and engaged with the vest section, with the lower panel deployed from the skirt section, and with the front opening, the arm holes and the access holes closed from within the vest section to cover the user's arms against his/her torso, the over-garment is conveniently configured for use as a sleeping bag.

As intended for the present invention, the hood, the vest section and the skirt section are each made of a quilted insulation material that is held between an inner shell and an outer shell, wherein the inner shell and the outer shell are each made of a breathable semi-permeable material.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION OF THE PREFERRED EMBODIMENTS

Figure 1:
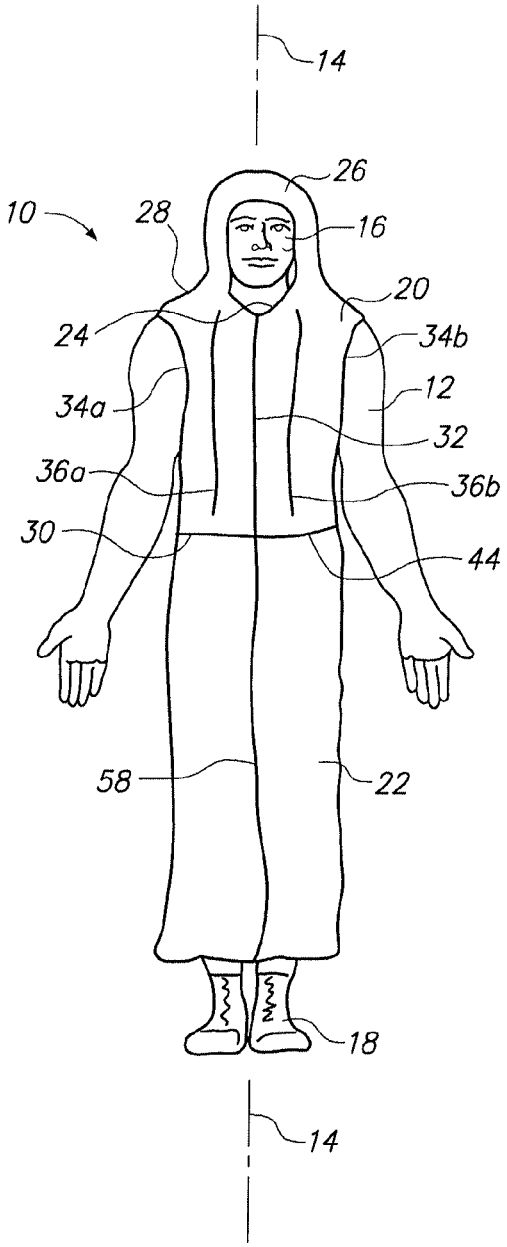
FIG. 1 is a front view of a sectionalized over-garment in accordance with the present invention, while it is being worn by a user.

Referring initially to FIG. 1, an over-garment in accordance with the present invention is shown and is generally designated 10. As shown, the over-garment 10 is being worn by a user 12. For reference purposes in describing the over-garment 10, consider that the user 12 defines a vertical axis 14 which extends between his/her head 16 and feet 18 when he/she is standing. Further, for disclosure purposes, modifiers such as upper (above), lower (below), left (lateral), right (lateral), front (anterior) and back (posterior) are herein anatomically referenced on the user 12.

As shown FIG. 1, the over-garment 10 includes a vest section 20 and a skirt section 22. In detail, the vest section establishes a collar 24, and it includes a hood 26 above the collar 24 to configure the vest section 20 as a parka. A shoulder portion 28 of the vest section 20 is established below the collar 24, and the vest section 20 drapes over the torso of the user 12 to extend from the shoulder portion 28 of the vest section 20 to a bottom hem 30.

Figure 1A:
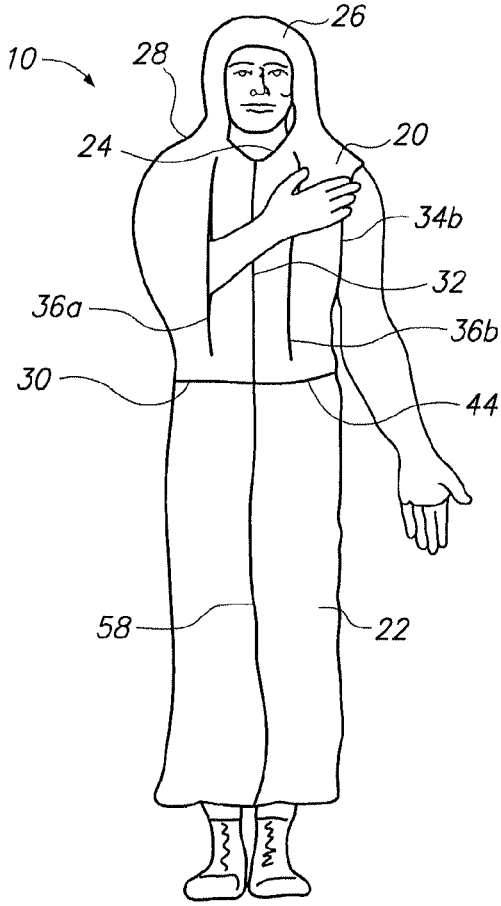
FIG. 1A is a view of the sectionalized over-garment as seen in FIG. 1 with the user reaching from within the over-garment, to a location outside the over-garment.

Still referring to FIG. 1, it will be seen that the vest section 20 is formed with a front body opening 32. As shown, the front body opening 32 is substantially parallel to the axis 14 defined by the user 12, and it extends from the collar 24 to the bottom hem 30. As is readily apparent, this body opening 32 is provided so the user 12 can put on the vest section 20. Specifically, this is done by respectively inserting arms of the user 12 through a right arm hole 34*a* and a left arm hole 34*b*. The body opening 32 can then be selectively closed to cover the torso of the user 12 as shown in FIG. 1. FIG. 1 also shows that the vest section 20 includes a right access hole 36*a* which is between the body opening 32 and the right arm hole 34*a*, and a left access hole 36*b* which is between the body opening 32 and the left arm hole 34*b*. FIG. 1A is provided to show that the user 12 can functionally extend his/her arm(s) through an access hole 36*a* or 36*b* as an alternative to having the arm extend from the vest section 20 through respective arm hole 34*a* or 34*b*. Moreover, it is to be appreciated that when an access hole 36*a*, and/or 36*b*, is/are being used, the associated arm hole 34*a* and/or 34*b* can be closed, and vice versa. Further, it is to be appreciated that the selective opening and closing of the front body opening 32, and/or the arm holes 34*a* and 34*b*, as well as the access holes 36*a* and 36*b*, can all be accomplished by the user 12 from within the vest section 20.

Figure 2:
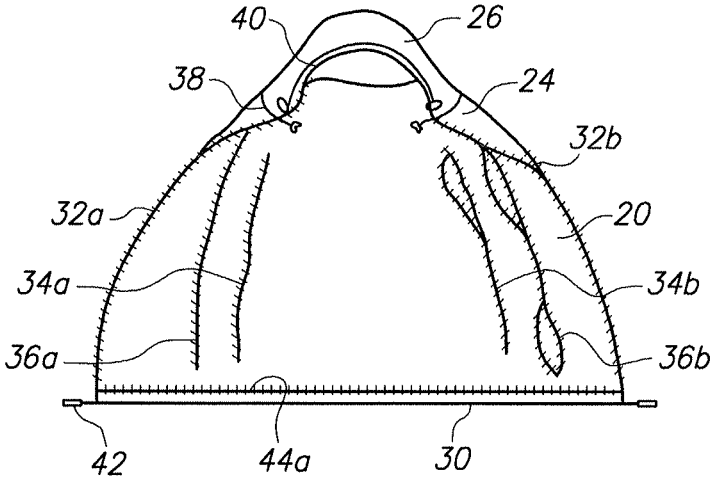
FIG. 2 is a layout view of the inside of the vest section of the sectionalized over-garment.
Figure 3A:
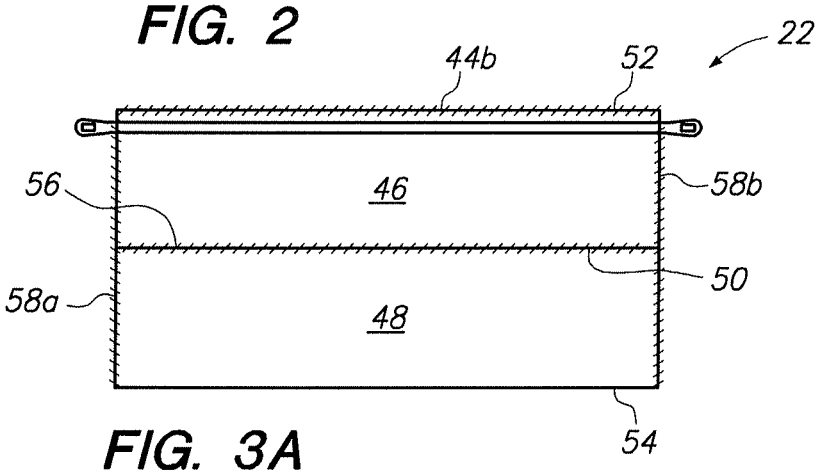
FIG. 3A is a layout view of the inside of the skirt section of the sectionalized over-garment.

In FIG. 2 it is shown that the hood 26 includes both a neck drawstring 38, which is oriented along the collar 24 to close the hood 26 onto the neck of the user 12, and a face drawstring 40 which is oriented on the hood 26 to hold the hood 26 on the head of the user 12. Also shown in FIG. 2 is a waist drawstring 42 that extends along the bottom hem 30, and which can be cinched to close the vest section 20 against the waist of the user 12. FIG. 2 further indicates that the vest section 20 includes zipper-halves 32*a* and 32*b* which engage with each other to close the front body opening 32. Also indicated in FIG. 2 is that the arm holes 34*a* and 34*b* are opened and closed with a zipper (not numerically designated), as are the access holes 36*a* and 36*b*. Additionally, FIG. 2 shows a zipper-half 44*a* extending along the bottom hem 30 of the vest section 20. Further, FIG. 3A shows a zipper-half 44*b* which is affixed to the skirt section 22, and which can be engaged with the zipper-half 44*a* to connect and hold the vest section 20 with the skirt section 22. FIGS. 1 and 1A show that with this engagement, the present invention provides for a full body over-garment 10.

FIG. 3A shows that an upper panel 46 and a lower panel 48 both overlie the inside of skirt section 22. As indicated, both panels 46 and 48 are connected together at a centerline 50 which is defined to be midway between an upper edge 52 of the skirt section 22 and a lower edge 54. When they are connected together, the panels 46 and 48 are respectively extended to cover the skirt section 22 between the upper edge 52 and the lower edge 54. As best appreciated with reference to FIG. 3B, this connection between panels 46 and 48 is made by a zipper 56. To do this, the zipper 56 includes an upper zipper-half 56*a*, which is affixed to the upper panel 46 and a lower zipper-half 56*b*, which is affixed to the lower panel 48.

Figure 3B:
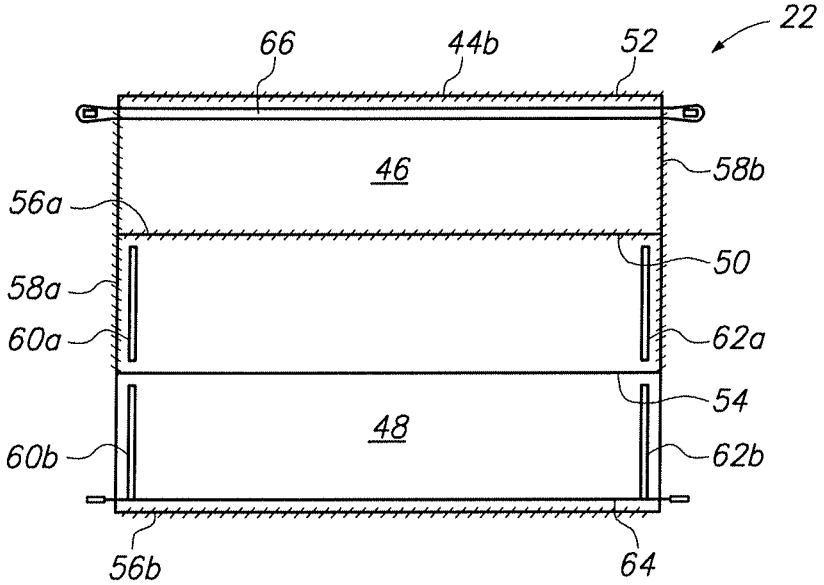
FIG. 3B is a view of the skirt section as shown in FIG. 3A with a lower panel deployed from the skirt section.

By cross referencing FIG. 3A with FIG. 3B, it will be appreciated that by manipulating the zipper 56, the lower panel 48 can be deployed from the skirt section 22. In a separate operation, by cross referencing FIG. 3B with FIG. 1, or FIG. 1A, it will be appreciated that a side-edge zipper-half 58*a* can be engaged with a side-edge zipper-half 58*b* to establish a zipper 58 that will hold the skirt section 22 around the legs and lower body of the user 12. Still referring to FIG. 3B, it is to be further appreciated that a fastener 60*a* on skirt section 22 will interact with a fastener 60*b* on the lower panel 48; that a fastener 62*a* on skirt section 22 will interact with a fastener 62*b* on the lower panel 48; and that together the fasteners 60 and 62 will hold the lower panel 48 against the skirt section 22 when the zipper 56 is engaged. FIG. 3B further shows that the skirt section 22 will include a drawstring 64 on the lower panel 48, and a belt 66 that is located along the upper edge 52 of the skirt section 22 for holding the skirt section 22 on the user 12.

As intended for the present invention, the over-garment 10 needs to be comfortable and not restrict action by the user 12. To do this, the hood 26, the vest section 20 and the skirt section 22 are each made of a flexible, quilted insulation material that is held between an inner shell (not shown) and an outer shell (not shown). The inner shell and the outer shell are each made of a breathable semi-permeable material. In combination, the insulation material and the shells can be made using fabrics well known in the pertinent art.

For a reconfiguration of the over-garment 10, it is to be appreciated that the vest section 20, with its hood 26, when used alone, will function as a parka. Further, as shown in FIGS. 1 and 1A, when the vest section 20 is joined with the skirt section 22 by the zipper 44, the result is a full body over-garment (see FIGS. 1 and 1A).

To convert the parka into a sleeping bag, it is first necessary to cover and secure the hood 26 on the head 16 of the user 12. The skirt section 22 can then be engaged with the vest section 20 using the zipper 44, and the skirt section 22 can be closed around the legs of the user 12 by closing the zipper 58. The lower panel 48 can then be deployed from the skirt section 22 and cinched by the drawstring 64 to cover the feet 18 of the user 12. Subsequently, in accordance with the design of the over-garment 10, the arm holes 34*a* and 34*b* can be closed with respective zippers (not shown). Importantly, this can be done by the user 12 from within the vest section 20. Likewise, the access holes 36*a* and 36*b* can also be closed with respective zippers (not shown) from within the vest section 20. Thus, the user 12 is enclosed by the over-garment in a sleeping bag.

As an added feature of the present invention, the skirt section 22 can be used as a make-shift shelter. For this purpose, the skirt section 22 can include grommets (not shown) which are respectively located at the four corners of the skirt section 22, and with a single grommet at the center of the skirt section 22. Specifically, as intended for the present invention, these various grommets will provide attachment points which can be used for engagement of the skirt section 22 with external structures in a manner that will provide protection for the user 12 from such weather conditions as rain, sleet, snow, wind, and direct sunlight.

While the particular Sectionalized Over-garment as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

What is claimed is:

1. A sectionalized over-garment for use in protecting a human user from adverse climatic conditions, wherein the user defines a vertical axis extending between the head and feet of the user when the user is standing, the over-garment comprising:

a vest section dimensioned to drape downwardly from the shoulders of the user and over the torso of the user, wherein the vest section is formed with a collar centered on the axis at the shoulders of the user and includes an anterior body opening coplanar with the axis and extending from the collar to a bottom hem of the vest section, and further wherein the vest section is formed with a pair of laterally positioned arm holes oriented substantially parallel to the axis and respectively extending from a shoulder portion of the vest section to a point adjacent the bottom hem of the vest section, and a pair of access holes located between the body opening and a respective arm hole and oriented substantially parallel to the body opening;

a zipper for selectively opening and closing the body opening;

a zipper-half extending along the length of the bottom hem;

a substantially rectangular shaped skirt section having an upper edge and a lower edge, with opposed, parallel side-edges extending therebetween;

a zipper-half extending along the upper edge of the skirt section for engagement with the zipper-half of the vest section to connect the skirt section with the vest section; and a pair of side-edge zipper-halves, with each side-edge zipper-half affixed to a respective side-edge of the skirt section for selective engagement between the zipper-halves to wrap and hold the skirt section around the legs of the user.

2. An over-garment as recited in claim 1 wherein the skirt section defines a centerline midway between and parallel to the upper edge and the lower edge of the skirt section, and wherein the skirt section further comprises:

an upper panel extending over the skirt section from the upper edge thereof to the centerline, with the upper panel being connected to the skirt section along the upper edge and along the side-edges of the skirt section;

an upper zipper-half affixed to the upper panel across the upper panel from the upper edge to position the upper zipper-half adjacent the centerline;

a lower panel extending from the lower edge of the skirt section;

a lower zipper-half affixed to the lower panel for selective engagement with the upper zipper-half to hold the lower panel over the skirt section between the lower edge of the skirt section and the centerline; and a pair of fasteners, with each fastener located along opposed side-edges of the skirt section between the lower edge and the centerline to secure the lower panel against the skirt section when the upper and lower zipper-halves are engaged.

3. An over-garment as recited in claim 2 further comprising:

a belt incorporated into the skirt section along the upper edge thereof to cinch the skirt section to the waist of the user; and a drawstring incorporated into the lower panel adjacent the lower zipper-half to cinch the lower panel over the feet of the user when the lower panel is disengaged from the upper zipper-half on the upper panel, and the lower panel is released from the fasteners to deploy the lower panel from the skirt section.

4. An over-garment as recited in claim 2 further comprising:

a hood connected with the collar of the vest section;

a neck drawstring oriented along the collar to close the hood onto the neck of the user; and a face drawstring oriented on the hood to hold the hood on the head of the user with the face of the user exposed.

5. An over-garment as recited in claim 4 wherein the hood, the vest section and the skirt section are each made of a quilted insulation material held between an inner shell and an outer shell, wherein the inner shell and the outer shell are each made of a breathable semi-permeable material.

6. An over-garment as recited in claim 4 wherein the skirt section is disengaged from the vest section for use of the vest section and the hood as a parka.

7. An over-garment as recited in claim 4 wherein the skirt section is engaged with the vest section, and the lower panel is deployed from the skirt section for use of the over-garment as a sleeping bag.

8. A sectionalized over-garment for use in protecting a human user from adverse climatic conditions, wherein the user defines a vertical axis extending between the head and feet of the user when the user is standing, the over-garment comprising:

a vest section dimensioned to drape downwardly from the shoulders of the user and over the torso of the user, wherein the vest section is formed with a collar centered on the axis at the shoulders of the user with a hood connected to the collar, wherein the hood includes a neck drawstring oriented along the collar to close the hood onto the neck of the user and a face drawstring oriented on the hood to hold the hood on the head of the user with the face of the user exposed, and wherein the vest section includes an anterior body opening coplanar with the axis and extending from the collar to a bottom hem of the vest section with a zipper for selectively opening and closing the body opening, and further wherein the vest section is formed with a pair of laterally positioned arm holes oriented substantially parallel to the axis and respectively extending from a shoulder of the vest section to a point adjacent the bottom hem of the vest section, and a pair of access holes located between the body opening and a respective arm hole and oriented substantially parallel to the body opening and wherein the vest section includes a zipper-half extending along the length of the bottom hem; and a substantially rectangular shaped skirt section having an upper edge and a lower edge, with opposed, parallel side-edges extending therebetween, and with a zipper-half extending along the upper edge of the skirt section for engagement with the zipper-half of the vest section to connect the skirt section with the vest section, and a pair of side-edge zipper-halves, with each side-edge zipper-half affixed to a respective side-edge of the skirt section for selective engagement between the zipper-halves to wrap and hold the skirt section around the legs of the user.

9. An over-garment as recited in claim 8 wherein the skirt section defines a centerline midway between and parallel to the upper edge and the lower edge of the skirt section, and wherein the skirt section further comprises:

an upper panel extending over the skirt section from the upper edge thereof to the centerline, with the upper panel being connected to the skirt section along the upper edge and along the side-edges of the skirt section;

an upper zipper-half affixed to the upper panel across the upper panel from the upper edge to position the upper zipper-half adjacent the centerline;

a lower panel extending from the lower edge of the skirt section;

a lower zipper-half affixed to the lower panel for selective engagement with the upper zipper-half to hold the lower panel over the skirt section between the lower edge of the skirt section and the centerline; and a pair of fasteners, with each fastener located along opposed side-edges of the skirt section between the lower edge and the centerline to secure the lower panel against the skirt section when the upper and lower zipper-halves are engaged.

10. An over-garment as recited in claim 9 further comprising:

a belt incorporated into the skirt section along the upper edge thereof to cinch the skirt section to the waist of the user; and a drawstring incorporated into the lower panel adjacent the lower zipper-half to cinch the lower panel over the feet of the user when the lower panel is disengaged from the upper zipper-half on the upper panel, and the lower panel is released from the fasteners to deploy the lower panel from the skirt section.

11. An over-garment as recited in claim 10 wherein the hood, the vest section and the skirt section are each made of a quilted insulation material held between an inner shell and an outer shell, wherein the inner shell and the outer shell are each made of a breathable semi-permeable material.

12. An over-garment as recited in claim 11 wherein the skirt section is engaged with the vest section, and the lower panel is deployed from the skirt section for use of the over-garment as a sleeping bag.

13. An over-garment as recited in claim 8 further comprising:

a pair of arm hole zippers respectively affixed with the vest section at an arm hole for selectively opening and closing the arm hole; and a pair of access zippers respectively affixed with the vest section at an access hole for selectively opening and closing the access hole.

14. A method for converting a parka into a sleeping bag, wherein a human user defines a vertical axis extending between the head and feet of the user when the user is standing, the method comprising the steps of:

providing a parka including a vest section with a hood, wherein the vest section is dimensioned to drape downwardly from the shoulders and over the torso of the user, and wherein the vest section includes an anterior body opening coplanar with the axis and having a zipper for selectively opening and closing the body opening, and further wherein the vest section is formed with a pair of laterally positioned arm holes, and a pair of access holes located between the body opening and a respective arm hole, and wherein the vest section includes a zipper-half extending along the length of a bottom hem of the vest section;

engaging a skirt section to the vest section, wherein the skirt section is rectangular shaped and has an upper edge and a lower edge, with opposed, parallel side-edges extending therebetween, with a zipper-half extending along the upper edge of the skirt section for engagement with the zipper-half at the hem of the vest section, and with a pair of side-edge zipper-halves for engagement with each other to wrap and hold the skirt section around the legs of the user;

deploying a lower panel from the skirt section to cover the feet of the user;

cinching the lower panel with a drawstring to cover the feet of the user; and closing the arm holes with a respective zipper, and the access holes with a respective zipper, to enclose the user in a sleeping bag.

15. A method as recited in claim 14 wherein the skirt section defines a centerline midway between and parallel to the upper edge and the lower edge of the skirt section, and wherein the skirt section further includes an upper panel extending over the skirt section from the upper edge thereof to the centerline, with the upper panel being connected to the skirt section along the upper edge and along the side-edges of the skirt section with an upper zipper-half affixed to the upper panel across the upper panel from the upper edge to position the upper zipper-half adjacent the centerline, and a lower panel extending from the lower edge of the skirt section with a lower zipper-half affixed to the lower panel for selective engagement with the upper zipper-half to hold the lower panel over the skirt section between the lower edge of the skirt section and the centerline, and a pair of fasteners, with each fastener located along opposed side-edges of the skirt section between the lower edge and the centerline to secure the lower panel against the skirt section when the upper and lower zipper-halves are engaged.

16. A method as recited in claim 15 wherein the hood of the vest section includes a neck drawstring oriented on the hood to close the hood onto the neck of the user, and a face drawstring oriented on the hood to hold the hood on the head of the user with the face of the user exposed.

17. A method as recited in claim 16 wherein the hood, the vest section and the skirt section are each made of a quilted insulation material held between an inner shell and an outer shell, wherein the inner shell and the outer shell are each made of a breathable semi-permeable material.

18. A method as recited in claim 14 wherein the closing step is accomplished by manipulating zippers from inside the vest section.

* * * * *